US006458039B1

(12) United States Patent
Fontes

(10) Patent No.: US 6,458,039 B1
(45) Date of Patent: Oct. 1, 2002

(54) GOLF AID PUTTING DEVICE

(76) Inventor: Joseph Robert Fontes, 10 Melody La., Johnston, RI (US) 02919

( * ) Notice: Subject to any disclaimer, the term of this patent is extended or adjusted under 35 U.S.C. 154(b) by 0 days.

(21) Appl. No.: 09/769,857

(22) Filed: Jan. 25, 2001

(51) Int. Cl.[7] ..... A63B 53/06; A63B 53/16; A63B 69/36

(52) U.S. Cl. ..... 473/258; 473/260; 473/265

(58) Field of Search ..... 473/226, 227, 473/257, 258, 260–265, 328; 273/191 R, 192

(56) References Cited

U.S. PATENT DOCUMENTS

| | | | | |
|---|---|---|---|---|
| 2,084,901 A | | 6/1937 | Eisenberg | |
| 2,303,736 A | | 12/1942 | Hall | |
| 2,340,793 A | | 2/1944 | Chapman | |
| 2,866,645 A | | 12/1958 | Cayot | |
| 3,104,108 A | | 9/1963 | Robertson | |
| 3,132,865 A | | 5/1964 | Parker | |
| 4,437,669 A | * | 3/1984 | Pelz | 473/265 |
| 5,072,943 A | | 12/1991 | Sindelar | |
| 5,150,904 A | | 9/1992 | Sindelar | |
| 5,152,534 A | | 10/1992 | Sindelar | |
| 5,332,211 A | * | 7/1994 | Rife et al. | 273/DIG. 21 |
| 5,672,114 A | | 9/1997 | Tu | |
| 6,159,106 A | * | 12/2000 | Adams | 434/252 |

* cited by examiner

*Primary Examiner*—Paul T. Sewell
*Assistant Examiner*—Mitra Aryanpour
(74) *Attorney, Agent, or Firm*—Salter & Michaelson

(57) ABSTRACT

A golf aid putting device includes a conventional golf club putter having a handle portion, a shaft portion and a putter head. A keel member is releasably secured to a bottom surface of the putter head for engagement with a track portion of the putting device for teaching the correct putting technique. The track portion of the putting device may be positioned on any horizontal supporting surface. The track portion includes a base member and a guide plate member having a curved top edge, said guide plate extending upwardly from the base member in perpendicular relation thereto wherein the keel member engages against the outside surface of the guide plate member and the curved top edge thereof to determine the path of movement of the putter during its back and forward swings.

4 Claims, 10 Drawing Sheets

FIG. 5
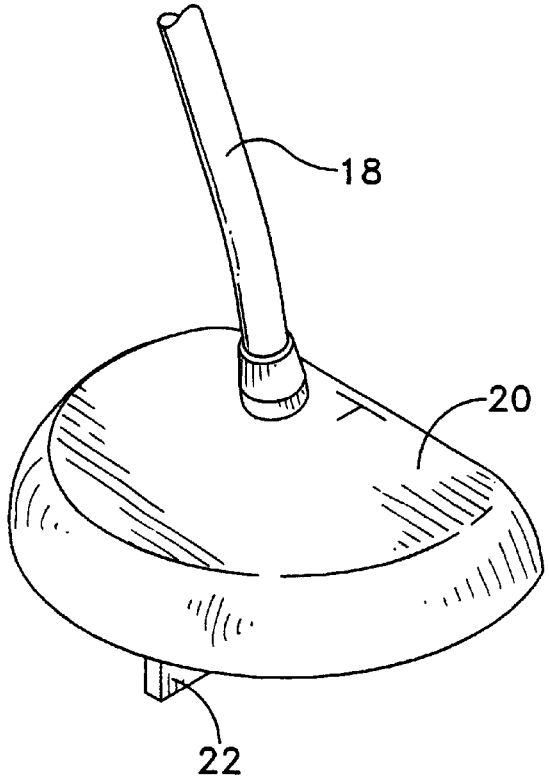
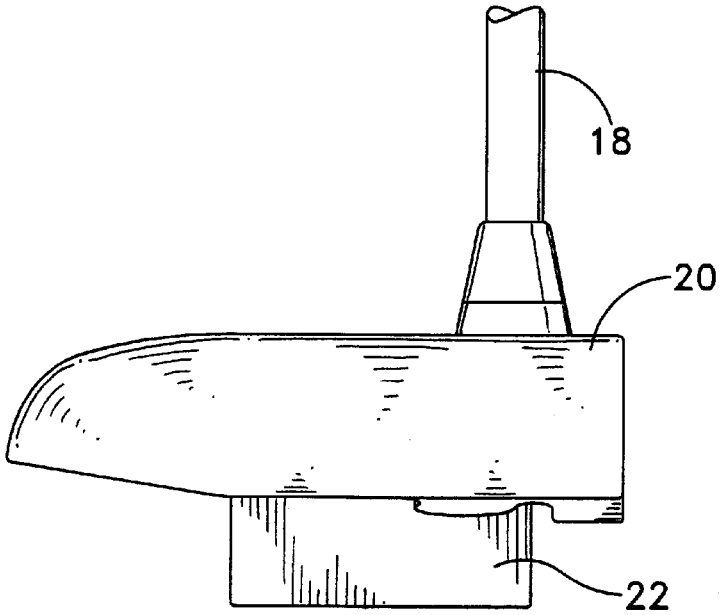
FIG. 6

GOLF AID PUTTING DEVICE

BACKGROUND AND SUMMARY OF INVENTION

This invention relates generally to the game of golf and more particularly to a golf practice putting device which helps teach a golf player the correct golf putting stroke.

The game of golf is a sporting activity that has immensely grown in popularity over the past few decades. For some, the game is a type of addiction which provides relaxation, social activity, and even a small amount of exercise. For the avid golfer, the game of golf is a way of life. Many avid golfers are consistently looking for new ways which may be helpful for improving their golf game. The instant invention is directed to a golf practice putting device which helps teach a golfer an improved putting stroke.

There have been many different types of golf training devices which have heretofore been known in the prior art. In this regard U.S. Pat. No. 2,084,901 issued to W. Eisenberg discloses a putting device comprising a carriage member which is movably associated with a track member for practicing the correct putting stroke. Specifically, the head of the golf club putter is received in the carriage member and rides up and down the track member to simulate the correct putting technique. A disadvantage to this apparatus is its large and bulky size. Other relevant Patents which are bulky, large in size, relatively expensive and somewhat outdated are U.S. Pat. No. 2,303,736 issued to E. E. Hall; U.S. Pat. No. 2,340,793 issued to A. W. Chapman; U.S. Pat. No. 2,866,645 issued to L. B. Cayot; U.S. Pat. No. 3,104,108 issued to R. R. Robertson; and U.S. Pat. No. 3,132,865 issued to J. Parker. Also of interest are U.S. Pat. Nos. 5,072,943, 5,150,904, and 5,152,534 all issued to Sindelar which disclose a more simple and modem golf putting training device.

The instant invention is directed to a golf aid putting device which includes a conventional golf club putter having a handle portion, a shaft portion and a putter head. A keel member is releasably secured to the bottom surface of the putter head for engagement with a track portion of the putting device for teaching the correct putting technique. The track portion of the putting device may be releasably secured to a substrate at any desired location for practicing the correct putting stroke. The track portion includes a base member and a guide plate member which extends upwardly from the base member in perpendicular relation thereto. The keel member engages against the outside surface of the guide plate and directs movement of the putter head for teaching the correct putting stroke.

Accordingly, among the several objects of the instant invention are: the provision of a golf practice putting device which helps teaches its user the correct putting technique; the provision of a practice putting device which has an arcuate track member for guiding the putter head through a correct back-swing and follow-through; the provision of a practice putting device which has a releasable guide member attached to the bottom of the putter head; the provision of a practice putting device which may be releasably secured to a substrate at any desirable putting location; and the provision of a practice putting device which is neat and attractive in appearance; the provision of a practice putting device which cost efficient and easy to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention:

FIG. 5 is a perspective view of the golf club putter head;

FIG. 6 is a front view thereof;

DETAILED DESCRIPTION OF THE PREFERRED EMBODIMENT

Figure 1:
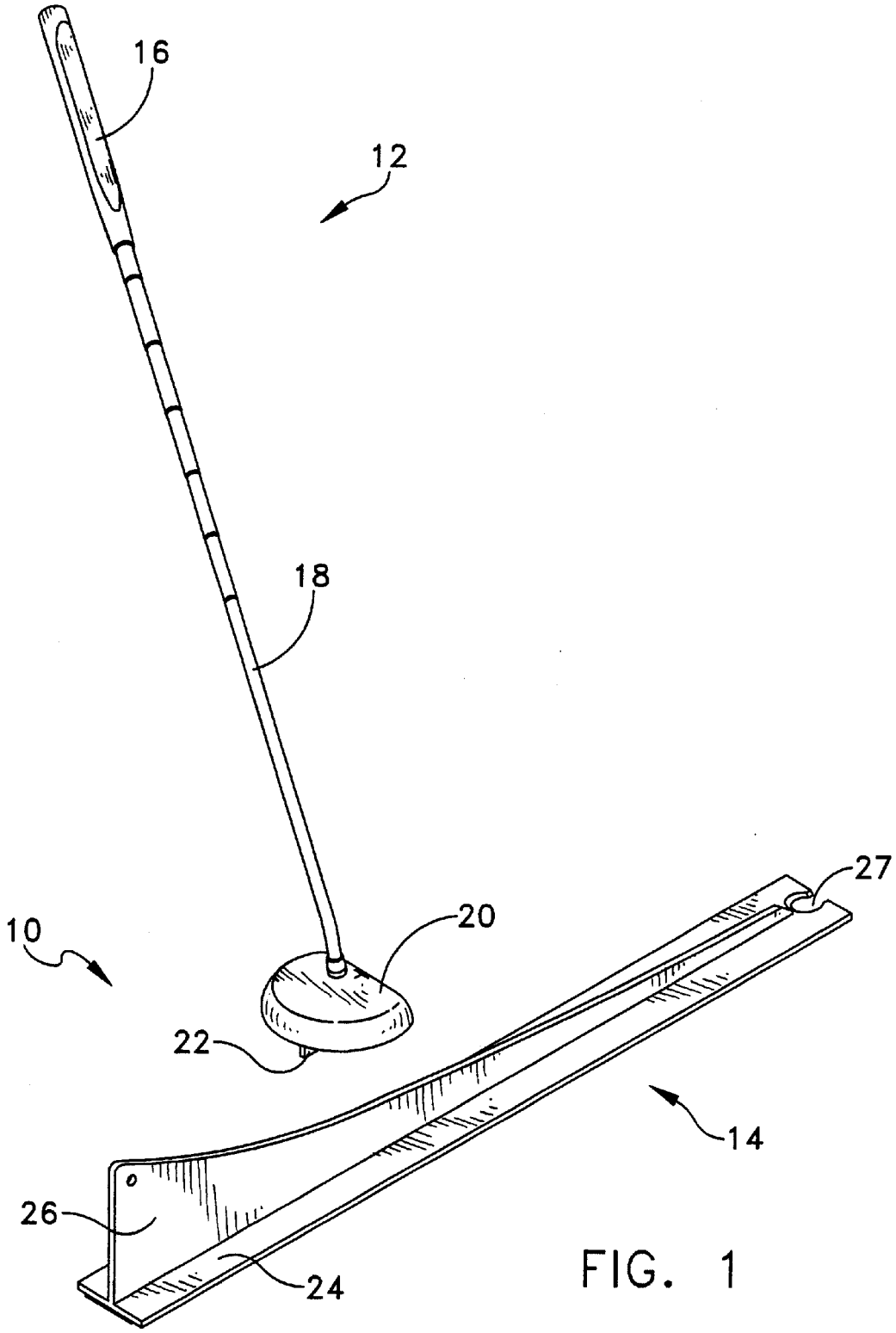
FIG. 1 is a perspective view showing the golf aid putting device of the instant invention.

Referring now to the drawings, and more particularly to FIG. 1, the golf practice putting device of the instant invention is shown and generally indicated at 10. As will hereinafter be more fully described, the instant invention provides for a unique golf putter practice device which helps teach a golf player the correct putting stroke. Specifically, the combination of a curved track member and a keel member releasably attached to the bottom of the putter head helps teach the user the correct back-swing and follow-through for learning the correct putting stroke.

The practice putting device 10 includes a golf club putter generally indicated at 12 and a practice putting track generally indicated at 14. The golf club putter 12 includes a grip portion 16, a shaft portion 18, a putter head 20 and a keel member 22 which is releasably attached to the bottom of the putter head 20. The practice putting track 14 includes a base portion 24 and a curved or arcuate track member 26. A notch 27 formed at one end of the base portion 24 of the putting track 14 is adapted to receive a golf ball therein.

Figure 2:
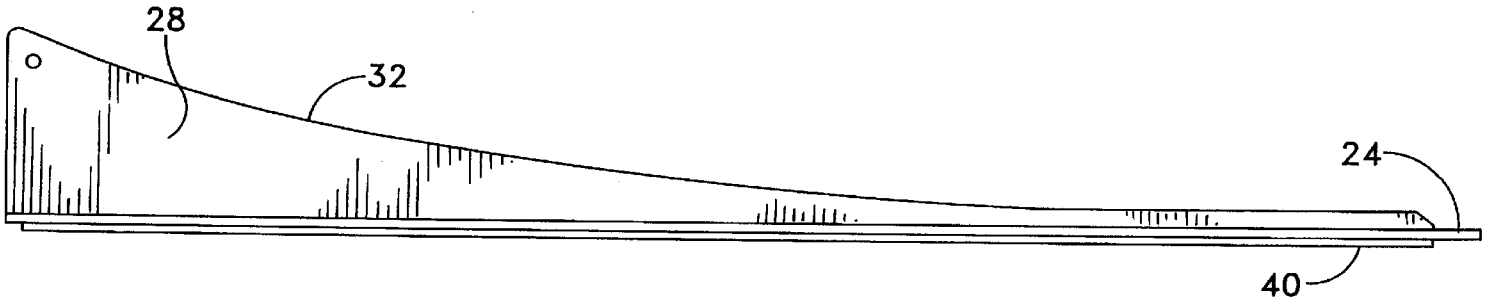
FIG. 2 is a side view of the track portion of the golf aid putting device of the instant invention.
Figure 3:
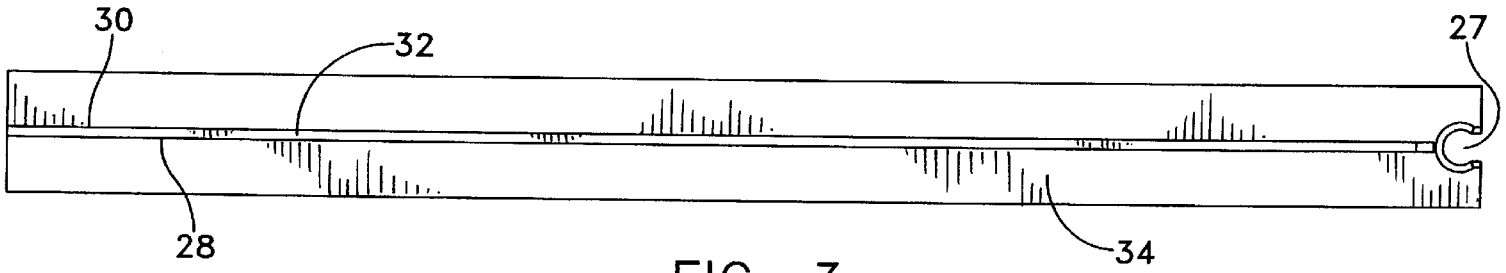
FIG. 3 is a top view thereof.
Figure 4:
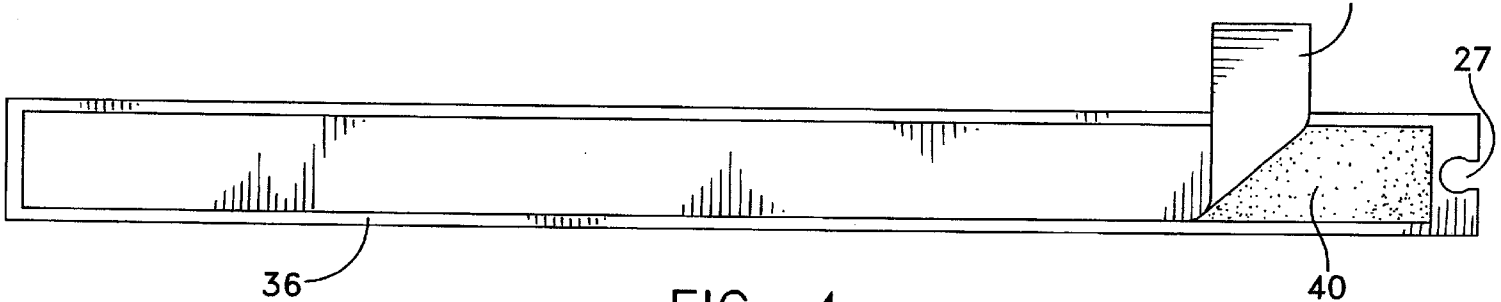
FIG. 4 is a bottom view thereof.
Figure 7:
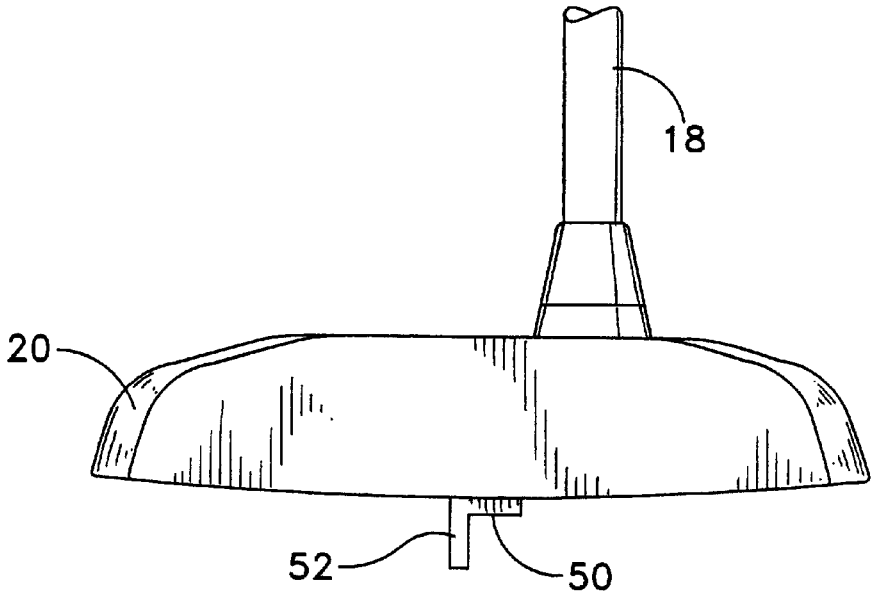
FIG. 7 is a side view thereof.
Figure 8:
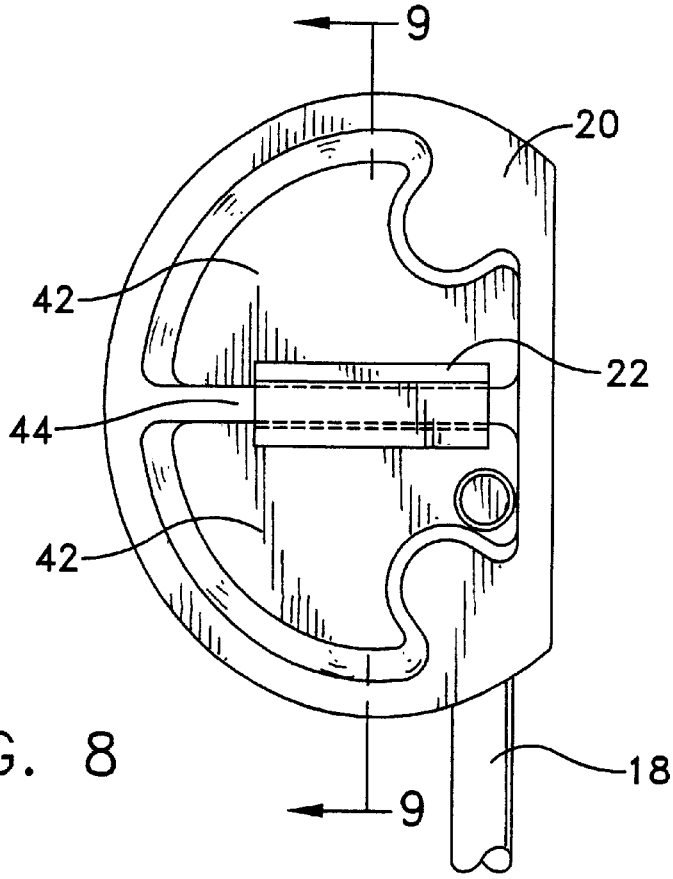
FIG. 8 is a bottom view thereof.
Figure 9:
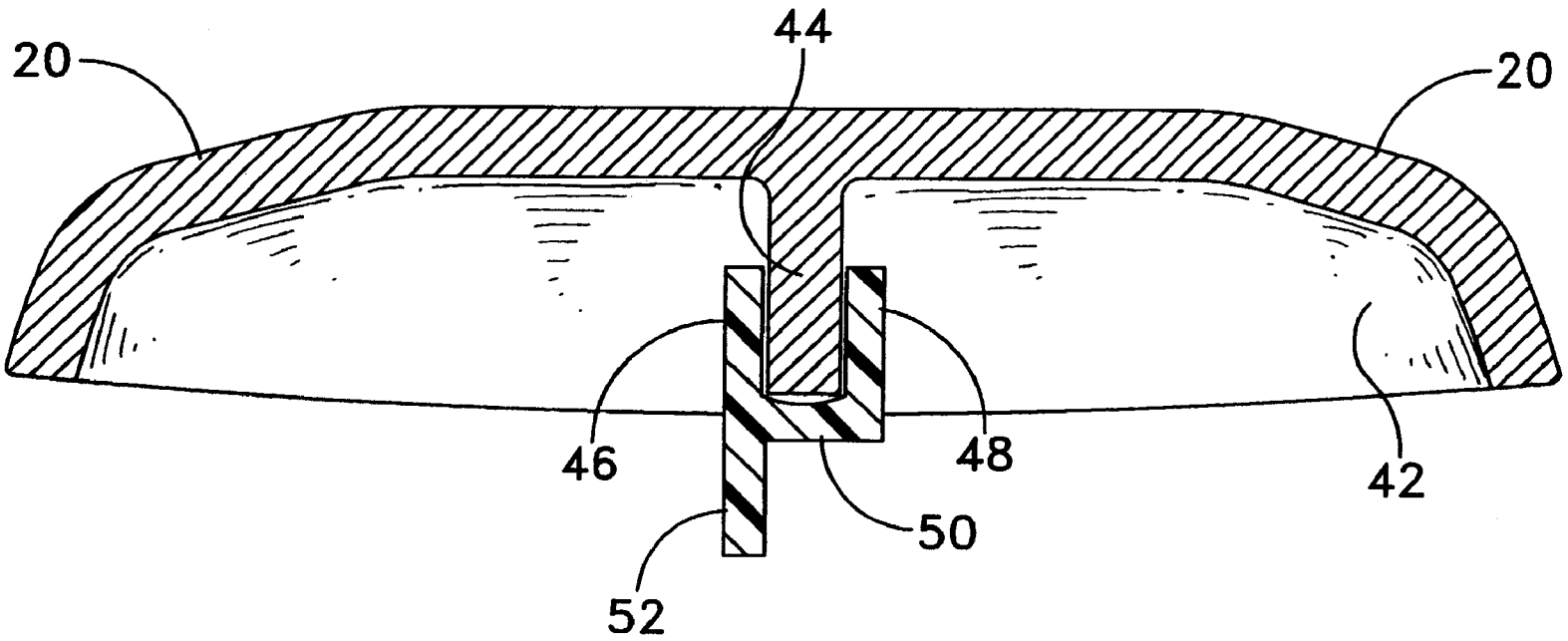
FIG. 9 is a cross-sectional view taken along lines 9—9 of FIG. 8.
Figure 10:
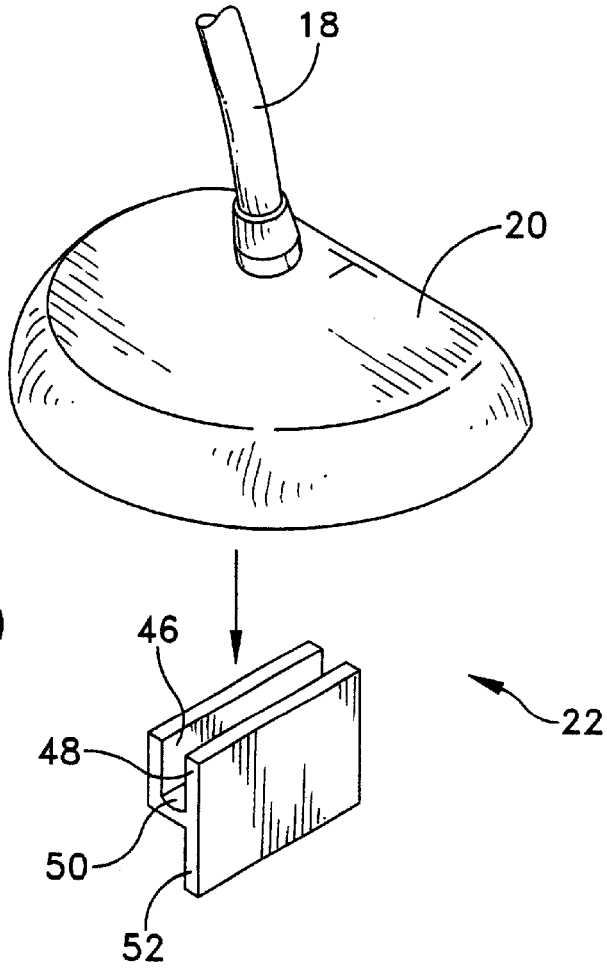
FIG. 10 is an exploded view showing the golf club putter head and the guide piece of the golf aid putting device of the instant invention.
Figure 11:
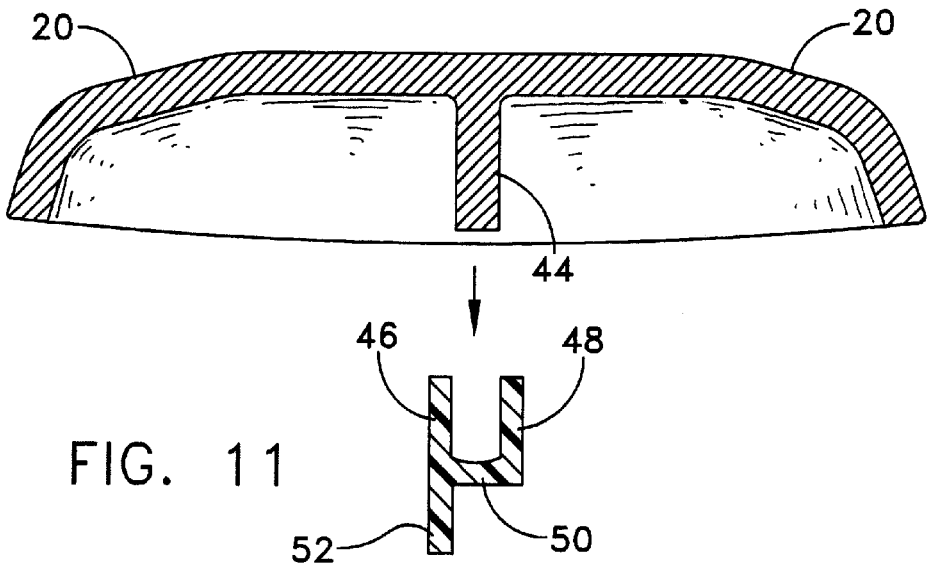
FIG. 11 is a cross-sectional view thereof.
Figure 12:
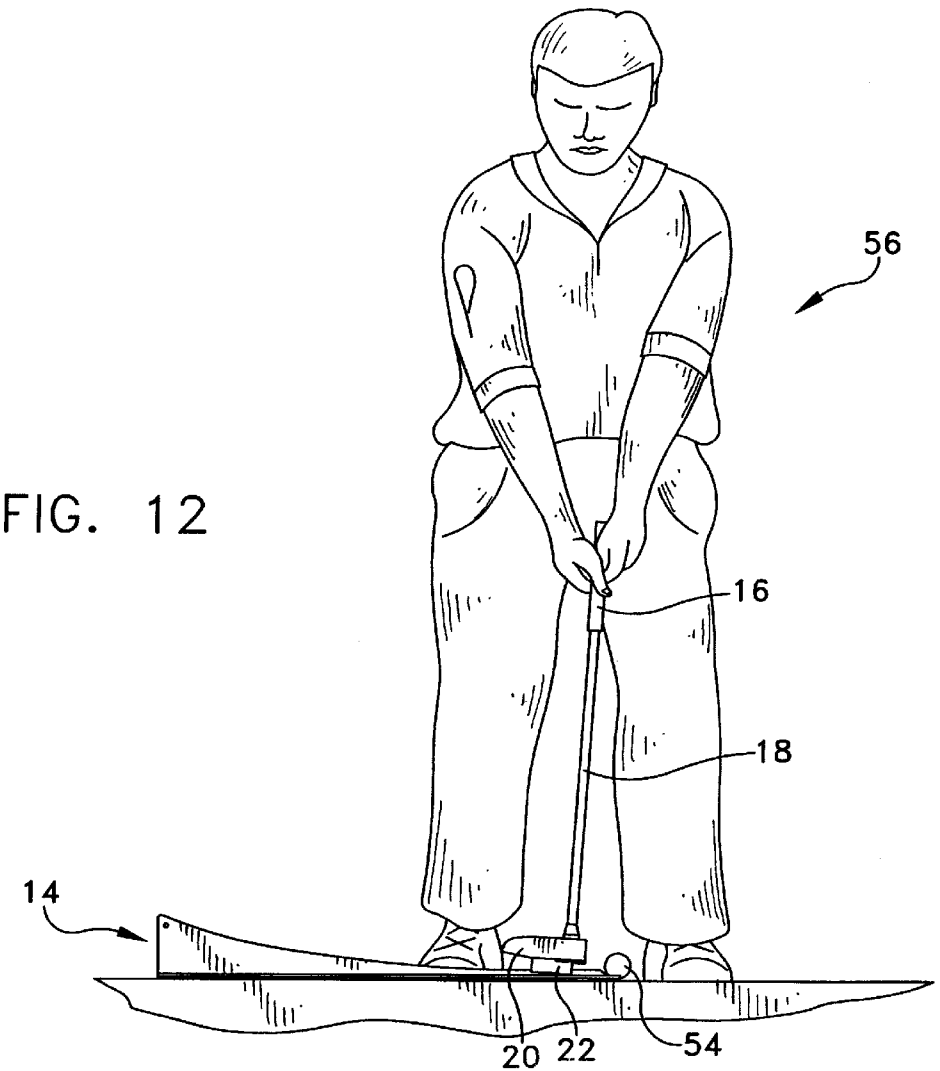
FIG. 12 is a perspective view showing the instant invention in use.

Referring now to FIGS. 2–4, the practice putting track 14 of the instant invention 10 is shown in more detail. Specifically, the track member 26 has an inside surface 28, an outside surface 30 and a top edge 32. The top edge of the track member 26 is curved so as to help teach the correct putting stroke by guiding the putter head 20 through a correct back-swing and follow-through. The base portion 24 of the putting track 14 has a top surface 34 and a bottom surface 36. Track member 28 curves upwardly from the top surface 34 of the base member 24 starting at the end adjacent notch 27. An adhesive layer 40 is provided on bottom surface 36 to enhance releasable securement of track 14 to a supporting horizontal surface 37. A release strip 38 covers adhesive 40 when device 10 is not in use. It will be understood that other means may be applied to bottom surface 36 such as a frictional rubber backing or the like (not shown) to effect attachment of track 14 to its supporting surface.

Referring now to FIGS. 5–11, the arrangement of the golf club putter head 20 and keel member assembly 22 is more clearly depicted. As most clearly shown in FIGS. 8–11, the keel member 22 is releasably secured to the bottom of the golf club putter head 20. Specifically, the bottom of the putter head 20 has a cavity 42 formed therein and a wall member 44 which runs transversely thereacross. The keel member 22 is preferably fabricated from any suitable plastic material and is generally U-shaped in cross-section for frictionally receiving wall member 44. Specifically, the keel member 22 comprises adjacent side walls 46 and 48 connected by an end wall 50 at corresponding ends thereof. One of said keel side walls 48 extends past said end wall 50 to form a guide flange 52 for guided movement of the putter head 20 for teaching the correct follow-through and back-swing for the putting stroke. The guide flange 52 forming a generally L-shape with said end 500.

Figure 13:
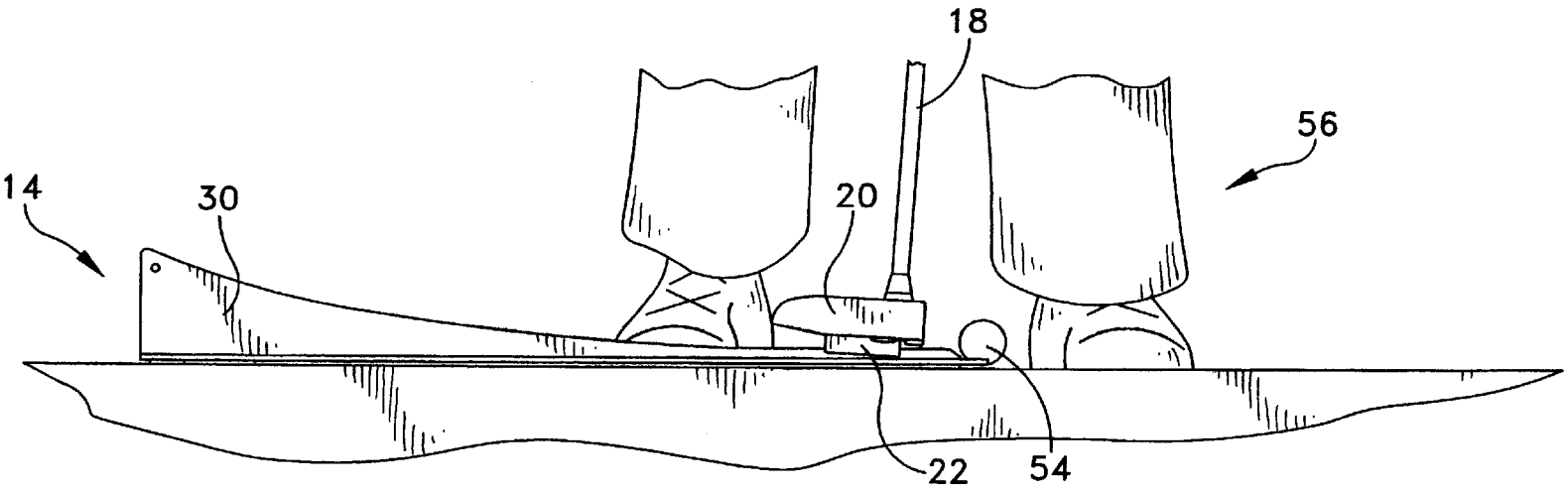
FIG. 13 is a fragmentary view thereof immediately before the practice putting stroke.
Figure 14:
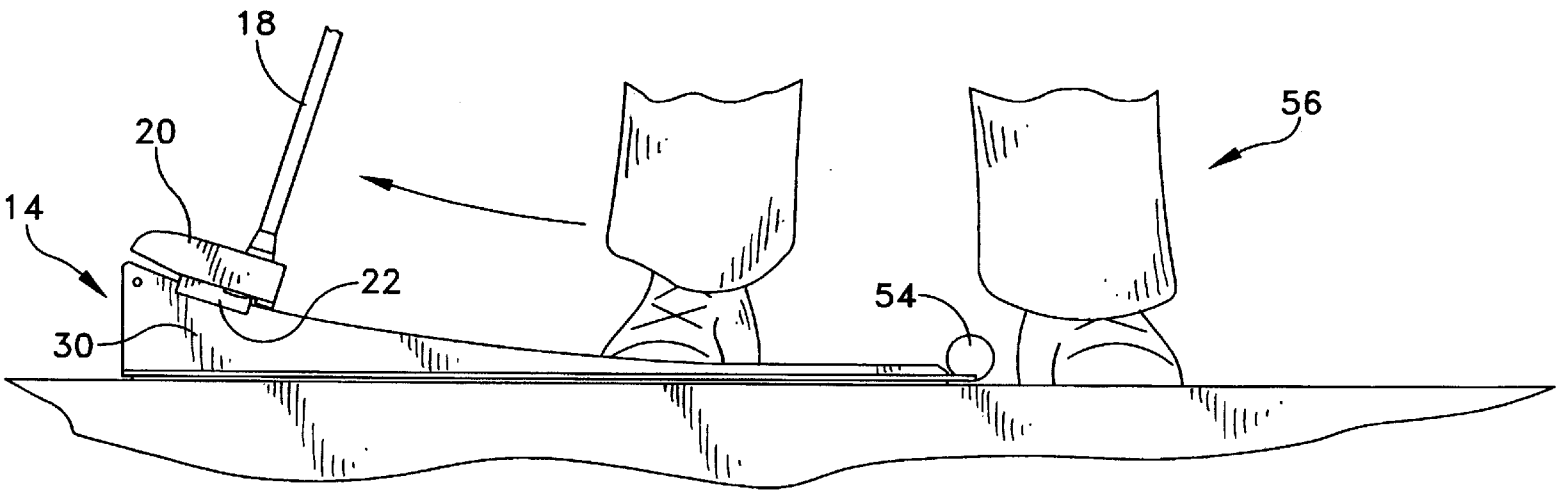
FIG. 14 is a fragmentary view showing the back-swing of the putting stroke.
Figure 15:
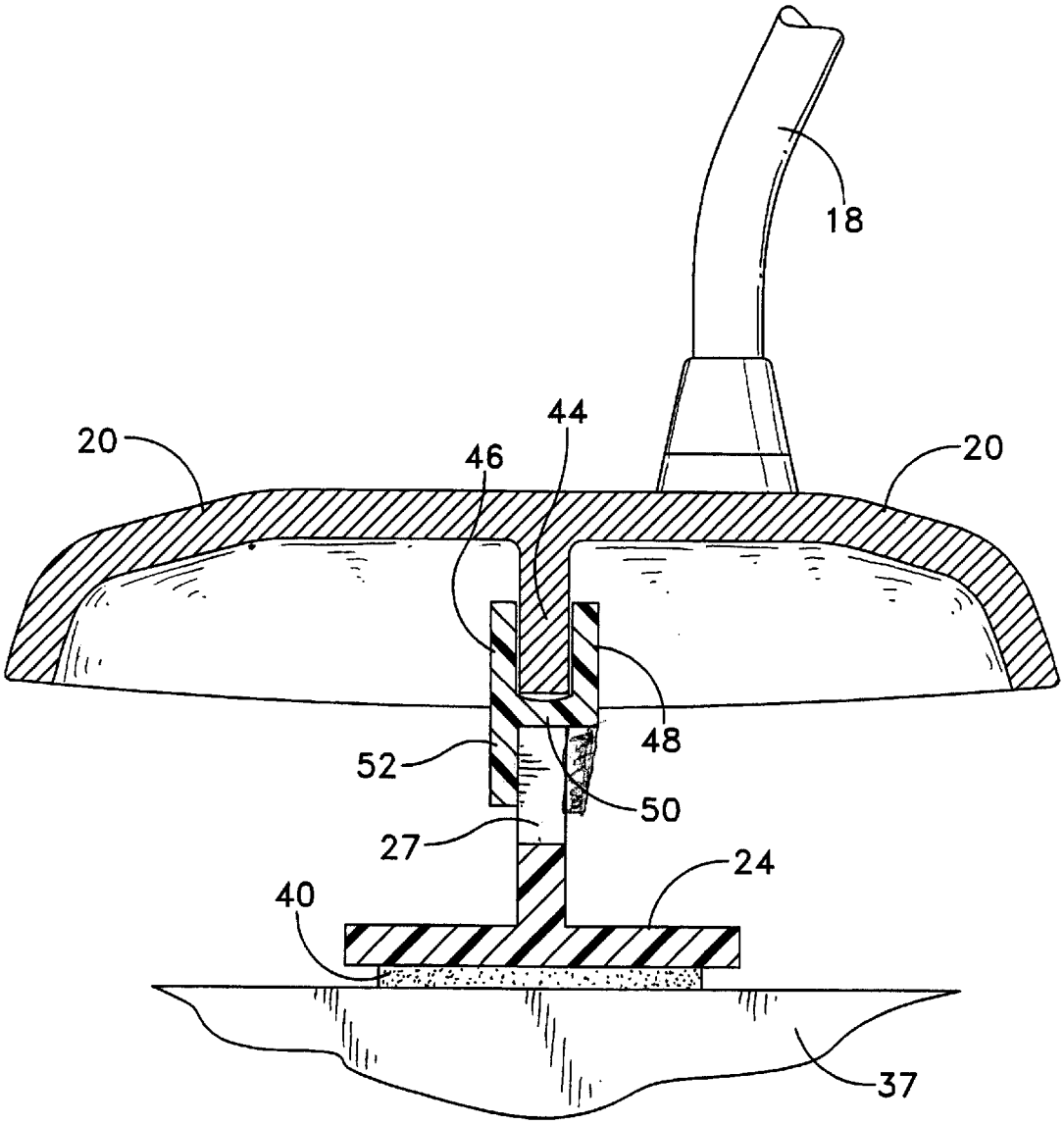
FIG. 15 is a cross sectional view thereof.
Figure 16:
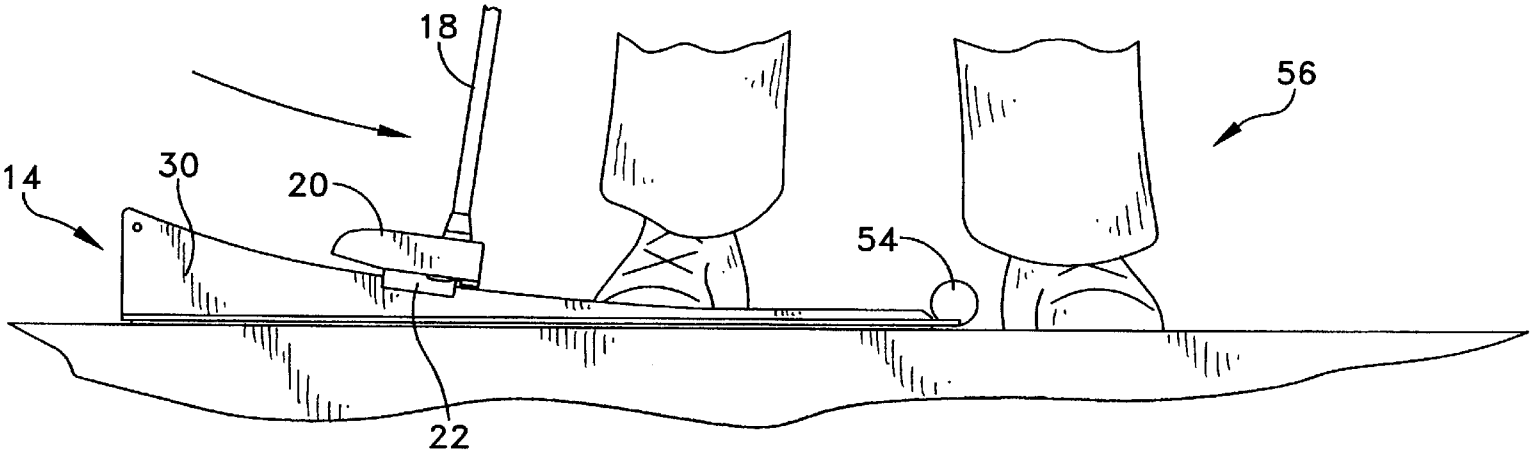
FIG. 16 is a fragmentary view showing the forward swing of the putting stroke.
Figure 17:
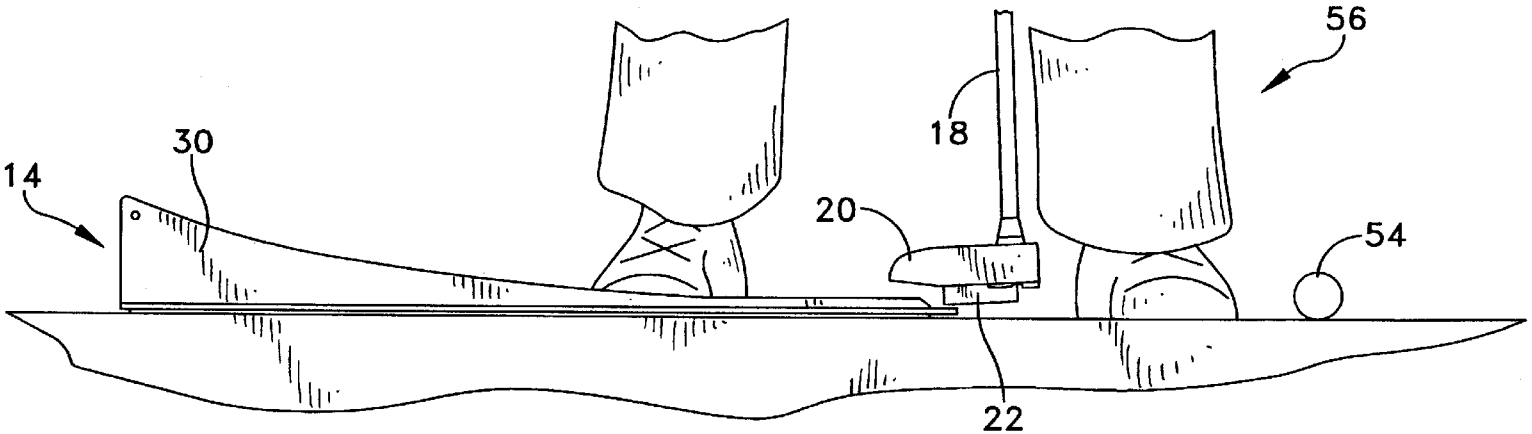
FIG. 17 is a fragmentary view showing the follow-through of the putting stroke.

Referring now to FIGS. 12–17, the golf practice putting device 10 of the instant invention is shown in use. As depicted in the drawings, A golf ball 54 is received within the notch 27 formed at the end of the base portion 24 of the practice track 14, and a golfer 56 then rests the guide flange 52 against the outside surface 30 of the arcuate track 26. As shown in FIGS. 13 and 14, as the golfer 56 begins the back-swing of the putting stroke, the guide flange 52 rides up the top edges 32 of arcuate track 26 for teaching the golfer 56 the proper back-swing. During both the back-swing and the forward-swing, it is important that the golfer maintain flange 52 in sliding engagement with outside surface 30 of track 26. It should be noted that the golfer 56 may angle the putter head 20 in either a forward or rearward direction as desired, so long as engagement is maintained between keel 22 and track 26. As shown in FIGS. 16 and 17, keel 22 slides down the arcuate track 26 and until putter head 20 makes contact with the golf ball 54, and follows through for learning the correct putting stroke.

Specifically, the height of the lowermost end of track 26, i.e., the end adjacent ball 54, is such that putter head 20 always strikes the ball at dead center and on the "sweet spot" of the putter head, provided that keel member 22 is maintained in proper sliding engagement with track 26 throughout the stroke. Also, proper engagement of keel member 22 with track 26 throughout the stroke prevents undesirable twisting of the user's hands. Also, another important feature of the instant invention is the fact that the putter head 20 is guided by keel 22 and track 26 through the entire back-stroke and forward swing, until the putter head makes contact with ball 54.

Repeated use of the training device 10 will teach the golfer 56 the correct putting stroke technique by ingraining it in his or her memory.

It should also be noted that track 26 can be customized as may be appropriate for different golfers. For example, the curve of top edge 32 can be varied. Also, track 26 does not necessarily have to be uni-planar, as shown. Specifically, the end of track 26 remote from notch 27 could be provided with a slight sidewise curve for those golfers who like to move the putter head inwardly at the top of the back-swing.

Also, the fact that keel member 22 is removably attached to wall 44 enables it to be removed when it is desired to use putter 12 as a regular putter during play.

It can therefore be seen that the instant invention provides for a new and improved golf practice putting device which teaches the user a correct back-swing and follow-through for teaching the correct putting stroke. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A golf club putter having a handle portion, a shaft portion, and a putter head;

a keel member attached to the bottom of said putter head, said keel member having a single guide forming a generally L-shape with an end wall and flange extending downwardly from the bottom of said putter head and extending in the direction that the putter head swings during the putting stroke;

a track assembly comprising a base member adapted to be positioned on a horizontal supporting surface;

said track assembly further comprising an elongated, substantially flat guide plate member extending upwardly from said base member in perpendicular relation thereof;

said base member having means adjacent one end thereof for positioning a golf ball;

said guide plate member having an upper edge that curves gently upward from a point adjacent said ball positioning means;

whereby when said putter head bottom and said keel member are maintained in engagement with said upper edge and with a side surface of said guide plate member, respectively, during the back and forward portions of the putting stroke, the path of the stroke will be determined by said guide plate member.

2. A golf aid putting device as set forth in claim 1, said ball positioning means comprising a circular opening in said base plate adjacent the lower end of said guide plate member, the height of said lower end being such that when the putter head completes its stroke, it makes contact with a ball positioned in said opening at dead center of the ball, and at the sweet spot of the putter head.

3. A golf club putter having a handle portion, a shaft portion, and a putter head;

a keel member attached to the bottom of said putter head, said keel member having a guide flange extending downwardly from the bottom of said putter head and extending in the direction that the putter head swings during the putting stroke;

a track assembly comprising a base member adapted to be positioned on a horizontal supporting surface;

said track assembly further comprising an elongated, substantially flat guide plate member extending upwardly from said base member in perpendicular relation thereof;

said base member having means adjacent one end thereof for positioning a golf ball;

said guide plate member having an upper edge that curves gently upward from a point adjacent said ball positioning means;

whereby when said keel member is maintained in engagement with said upper edge and with a side surface of said guide plate member, during the back and forward portions of the putting stroke, the path of the stroke will be back and forward portions of the putting stroke, the path of the stroke will be determined by said guide plate member, the means for attaching the keel member to the bottom of the putter head comprising a cavity formed at the bottom of the putter head, and a wall member extending through the center of said cavity, and means releasably securing said keel member to said wall member.

4. A golf aid putting device as set forth in claim 3, wherein said keel member has a pair of spaced walls that frictionally engage said wall member.

* * * * *